US006408743B2

(12) United States Patent
Niwa et al.

(10) Patent No.: US 6,408,743 B2
(45) Date of Patent: Jun. 25, 2002

(54) CURVED-SURFACE PRINTING METHOD APPLICABLE TO MEMBER EXPOSED TO HIGH-TEMPERATURE CLOSED ATMOSPHERE AND LAMP UNIT HAVING SAME APPLIED THERETO

(75) Inventors: Takeshi Niwa; Midori Ishikawa; Koichi Nakamura, all of Shizuoka (JP)

(73) Assignees: Cubic Co., Ltd., Shimizu (JP); Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/215,148

(22) Filed: Dec. 18, 1998

(30) Foreign Application Priority Data

Dec. 18, 1997 (JP) ..... 9-364628

(51) Int. Cl.[7] ..... B41F 17/00
(52) U.S. Cl. ..... 101/35; 156/230
(58) Field of Search ..... 101/35; 156/230, 156/237, 240, 356, 359

(56) References Cited

U.S. PATENT DOCUMENTS 4,010,057 A * 3/1977 Nakanishi ..... 156/384
4,388,866 A * 6/1983 Nakanishi ..... 101/426
4,436,571 A 3/1984 Nakanishi ..... 156/384
5,443,669 A * 8/1995 Tunker ..... 156/102

FOREIGN PATENT DOCUMENTS

JP 2-132000 5/1990
JP 9-254598 9/1997

* cited by examiner

*Primary Examiner*—Andrew H. Hirshfeld
*Assistant Examiner*—Darius N. Cone
(74) *Attorney, Agent, or Firm*—Wenderoth, Lind & Ponack, L.L.P.

(57) ABSTRACT

A curved-surface printing method applicable to a member exposed to a high-temperature closed atmosphere and a lamp unit to which such a method is applied. A transfer film formed by printing a transfer ink on a water-soluble film is floated on water in a water tank and then an object in the form of an extension, adapted to be arranged in a lamp unit, is downwardly pressed against the transfer film, resulting in the transfer ink being, by water pressure, transferred to the object by curved-surface printing. An activator coated on the transfer film prior to the transfer printing contains a plasticizer selected from dimethyl phthalate (DMP) and diethyl phthalate (DEP). A volatilization promoting drying treatment for volatilizing the platicizer is carried out after the transfer printing.

14 Claims, 3 Drawing Sheets

CURVED-SURFACE PRINTING METHOD APPLICABLE TO MEMBER EXPOSED TO HIGH-TEMPERATURE CLOSED ATMOSPHERE AND LAMP UNIT HAVING SAME APPLIED THERETO

BACKGROUND OF THE INVENTION

This invention relates to a curved-surface printing method applicable to a member exposed to a high-temperature closed atmosphere and a lamp having the method applied thereto, and more particularly to a curved-surface printing method which is effectively applicable to manufacturing of an extension exposed to a high-temperature closed atmosphere while being incorporated into a head lamp of an automobile or the like and a lamp unit to which the method is applied.

A development proceeded in a field of a design of an automobile or the like extends over a variety of parts. For example, such a design development is directed to detail of an extension arranged in a lamp unit of an automobile as well. In order to meet such requirements, it is necessarily required to carry out a coloring treatment as well as a molding treatment on the extension. However, when the extension is formed so as to have a three-dimensional configuration, the coloring treatment is restricted to execution in a relatively simple way. More specifically, the three-dimensional configuration causes the coloring treatment to be limited to coloring by spray coating, reproduction of metal coloring by vacuum deposition, utilization of colors of materials for the extension or the like, to thereby render formation of a pattern on the extension substantially impossible. However, recent diversification of a demand for a design treatment requires that the three-dimensional configuration be provided with a complicated pattern arrangement. More specifically, in an extension for a lamp unit wherein a normal head lamp and a fog lamp are covered with a single lens, a relatively large space is necessarily defined on a portion of the extension between an opening for the head lamp and that for the fog lamp, so that there is increased a demand for applying any desired pattern onto the space, to thereby provide the lamp unit with any added value or distinct properties.

Conventionally, water pressure transfer printing techniques are employed for curved-surface printing on a member formed to have such a three-dimensional configuration. The water pressure transfer printing is carried out in such a manner that a transfer film formed by coating a transfer ink onto a water-soluble film is floated on water in a water tank and then an object to which the transfer ink is to be transferred (hereinafter referred to as "object") such as an extension as described above or the like is downwardly pressed against the transfer film, resulting in the transfer ink being transferred to a surface of the object by water pressure. The transfer film has an activator applied thereto before or after it reaches the water, to thereby provide the transfer ink with stickiness.

A lamp unit including a head lamp and the like is heated at an interior thereof to an elevated temperature while being sealedly closed during operation thereof, because a bulb such as a halogen bulb or the like is kept turned on during the operation. Thus, when the curved-surface printing is carried out on an interior member of the lamp unit, a high-temperature closed atmosphere formed in the lamp unit due to the operation causes partial volatilization of the transfer ink and/or activator, leading to a problem of so-called fogging which causes generation of haze in the lamp unit. Essentially, the lamp unit must be designed so as to meet requirements of light distribution provided in a relevant law. Such fogging deteriorates light distribution performance of the lamp unit and a driver's field of vision.

Such fogging is generally defined in the form of a haze value measured using a direct-reading type haze computer manufactured by SUGA TEST INSTRUMENTS CO., LTD. (a Japanese corporation) according to a glass haze test procedure defined in ISO-6452. The glass haze test is generally carried out in a manner to heat a specimen in a closed vessel to volatilize a volatile ingredient from the specimen and deposit the volatile ingredient onto a glass plate. Then, a glass haze is calculated as a ratio of the amount of light scattered by the glass plate to the total amount of light transmitted through the glass plate. A glass haze of 10% or less measured by the above-described direct-reading type haze computer is determined as a criterion. Thus, a glass haze of 10% or less is used herein as a criterion for indicating that the occurrence of fogging is restrained. Also, a glass haze of 5% or less is judged to be desirable in view of a thickness of a lamp unit, an internal volume of a light emitting section of a bulb, a variation in individual lamp unit products in mass production and the like.

In order to restrain the occurrence of fogging, it would be considered that the extension is formed of a transparent material to have a partition-like shape, the light emitting section is divided into a lens-side space and a reflector-side space and printing on the extension is carried out at a portion of the extension positionally corresponding to the light-emitting section. However, such an approach causes the space for the light emitting section to be reduced, thereby failing to put the lamp unit to practical use. Thus, the prior art fails to permit the lamp unit, in which the extension having the printed pattern formed on a surface thereof is incorporated, to be put to practical use. Arrangement of the pattern is limited to a surface of the lamp unit.

SUMMARY OF THE INVENTION

The present invention has been made in view of the foregoing disadvantages of the prior art.

Accordingly, it is an object of the present invention to provide a curved-surface printing method applicable to a member exposed to a high-temperature closed atmosphere which is capable of effectively restraining the occurrence of fogging while ensuring satisfactory curved-surface printing on an extension arranged in a lamp unit or the like.

It is another object of the present invention to provide a lamp unit which is capable of permitting such a curved-surface printing method applicable to a member exposed to a high-temperature closed atmosphere to be effectively applied thereto.

In accordance with one aspect of the present invention, a curved-surface printing method is provided which is applicable to a member exposed to a high-temperature closed atmosphere. The curved-surface printing method includes the step of floating a transfer film on water in a water tank. The transfer film is formed by coating a transfer ink on a water-soluble film. The curved-surface printing method also includes the steps of downwardly pressing an object against the transfer film to print the transfer ink on a surface of the object by water pressure, providing the transfer film with stickiness sufficient to ensure transfer of the transfer ink to the object by means of an activator which contains a plasticizer ingredient selected from the group consisting of dimethyl phthalate (DMP) and diethyl phthalate (DEP), and carrying out a volatilization promoting drying treatment for substantially volatilizing the plasticizer ingredient after transfer of the transfer ink to the object.

In a preferred embodiment of the present invention, the curved-surface printing method further includes the step of draining the object of which a surface is still wet prior to the volatilization promoting drying treatment.

In a preferred embodiment of the present invention, the volatilization promoting drying treatment is carried out for about 30 to 60 minutes at a temperature of about 120° C.

In a preferred embodiment of the present invention, the draining step is carried out for about 15 minutes at a temperature of about 80° C.

In a preferred embodiment of the present invention, the draining step and volatilization promoting drying treatment are carried out in a single stage by adjusting a drying temperature and drying time.

In a preferred embodiment of the present invention, the curved-surface printing method further includes the step of subjecting the object to undercoating prior to the transfer printing of the transfer ink on the surface of the object.

In a preferred embodiment of the present invention, the object exhibits fogging of 10% or less in a glass haze test.

In a preferred embodiment of the present invention, the object exhibits fogging of 5% or less in a glass haze test.

In a preferred embodiment of the present invention, the object is an extension incorporated in a lamp unit.

In accordance with another aspect of the present invention, a lamp unit to which a curved-surface printing method applicable to a member exposed to a high-temperature closed atmosphere is applied is provided. The lamp unit includes a bulb acting as a light source, a shade for intercepting a part of light emitted from the bulb, a reflector for reflecting light emitted from the bulb, a lamp body arranged behind the reflector, a lens arranged so as to sealingly cover a whole front surface of the lamp body, and an extension arranged between the lens and the lamp body and formed with an opening of substantially the same configuration as a front projected shape of a light emitting section of the lamp unit. The extension is formed on a portion thereof other than the opening with a surface decoration by curved-surface printing. The surface decoration is formed so as to cause fogging of 10% or less in a glass haze test.

BRIEF DESCRIPTION OF THE DRAWINGS

These and other objects and many of the attendant advantage of the present invention will be readily appreciated as the same becomes better understood by reference to the following detailed description when considered in connection with the accompanying drawings; wherein.

DETAILED DESCRIPTION OF THE PREFERRED EMBODIMENTS

Now, the present invention will be described hereinafter with reference to the accompanying drawings.

Figure 1:
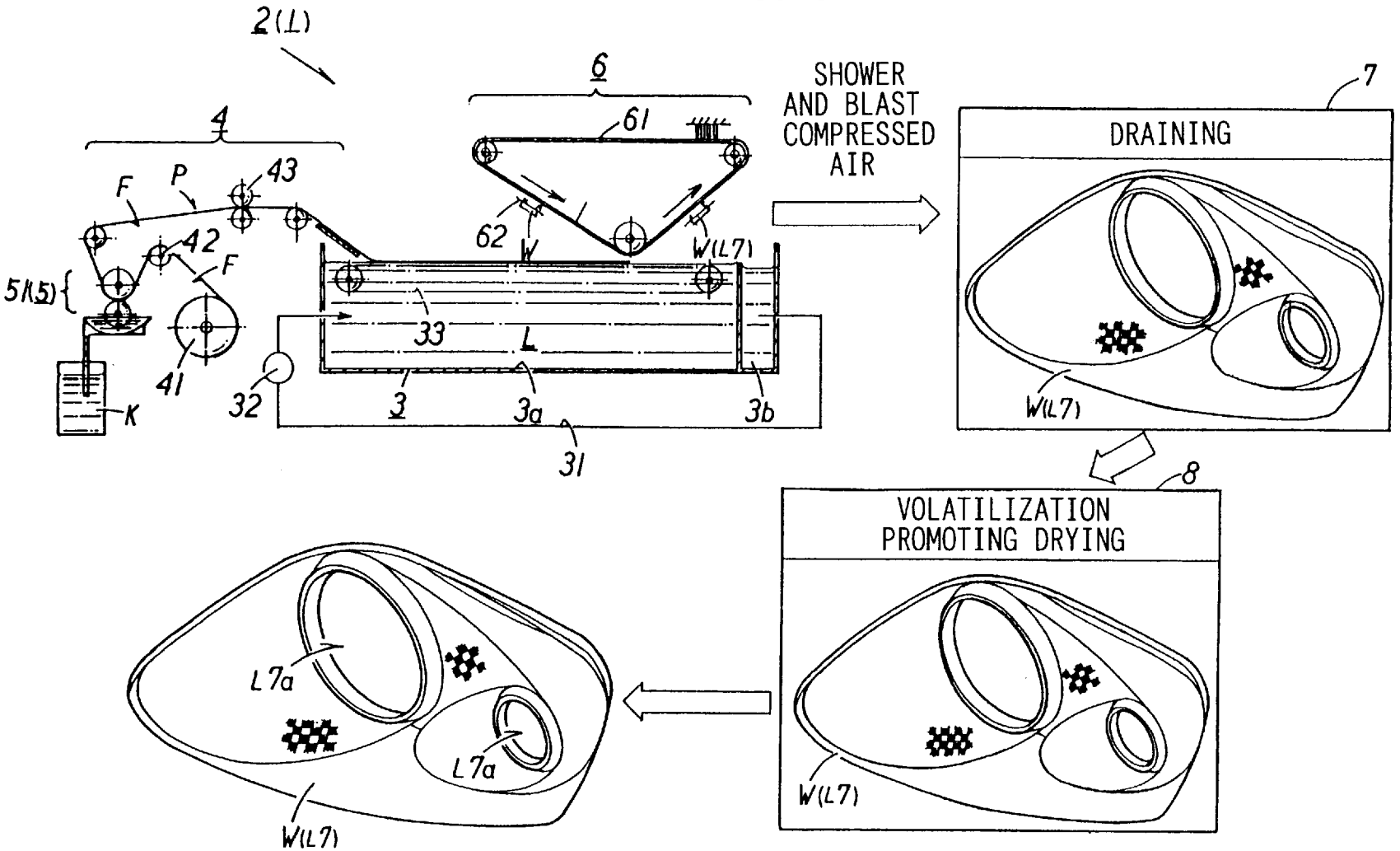
FIG. 1 is a pictorial flow diagram showing a curved-surface printing method according to the present invention which is effectively applicable to a member exposed to a high-temperature closed atmosphere.

Referring first to FIG. 1, a curved-surface printing apparatus suitable for use for execution of an embodiment of a curved-surface printing method according to the present invention which is effectively applicable to a member exposed to a high-temperature closed atmosphere is illustrated by way of example. In the illustrated embodiment, the curved-surface printing apparatus generally designated at reference numeral 1 is substantially constituted of a water pressure transfer printing apparatus 2. The water pressure transfer printing apparatus 2 may include a water tank 3, a transfer film feed unit 4, an activator coating unit 5, an object carrying unit 6, a dryer or draining unit 7 and a volatilization promoting dryer 8 by way of example.

The water tank 3 includes a treating tank 3*a* and an overflow tank 3*b*. In the illustrated embodiment, the treating tank 3*a* is stored therein with water L, so that water overflowing the tank 3*a* is guided to the overflow tank 3*b* and then gently returned through a circulation piping 31 to the treating tank 3a by means of a pump 32 so that a surface of the water L is prevented from becoming choppy. Any other suitable liquid may be substituted for the water L so long as it can swell or dissolve a carrier sheet for a transfer film F.

The treating tank 3*a* of the water tank 3 is provided therein with a chain conveyor 33, which is constituted of sprockets and a pair of chains arranged in proximity to the respective opposite lateral walls of the treating tank 3*a* and meshed with the sprockets so as to extend therebetween. The chain conveyor 33 travels in the same direction as movement of the transfer film F toward the overflow tank 3*b* along the surface of the water L, to thereby aid such movement of the transfer film F.

The transfer film feed unit 4 includes a film roll 41 which is formed by rolling or winding the transfer film F, a heating roll 42 for heating the transfer film F drawn out of the film roll 41, and a pair of drawing-out rolls 43 vertically arranged so as to apply a drawing-out force to the transfer film F. an upper one of the drawing-out rolls 43 is arranged so as to be in contact with only opposite side ends of the transfer film F, to thereby prevent a surface of the transfer film F which has an activator K coated thereon from being rubbed.

The transfer film F includes a carrier sheet constituted by a water-soluble film made of gelatin, sodium alginate, polyvinyl alcohol resin or the like. The carrier sheet is formed on one surface thereof with an ink-applied surface P, to thereby provide the transfer film F. The ink-applied surface P is formed by applying a transfer ink onto the surface of the carrier sheet while forming any desired pattern (transfer pattern) in a state previously dried.

The activator coating unit 5 is arranged between the heating roll 42 of the transfer film feed unit 4 and the drawing-out rolls 43 and includes a roller coater 51 for coating the activator K onto the transfer film F. In the illustrated embodiment, the activator coating unit 5, as described above, is arranged between the heating roll 42 and the drawing-out rolls 43. Alternatively, the activator coating unit 5 may be arranged in the vicinity of the drawing-out rolls 43 to downwardly apply the activator K onto the transfer film F immediately before the transfer film F is fed to the water tank 3 or after the transfer film F reaches the water L in the water tank 3.

The activator K functions to provide the transfer ink in a dry state coated on the ink-applied surface P of the transfer film F with stickiness, to thereby render the transfer ink transferable. The activator K may be made by mixing a resin ingredient, a solvent ingredient, a plasticizer ingredient, an extender pigment ingredient and the like with each other. The solvent ingredient functions to dissolve the ink to restore stickiness of the ink until completion of the transfer. The resin ingredient functions to ensure initial adhesion of the ink and prevent diffusion of the ink. The plasticizer ingredient acts to provide the resin ingredient with plasticity. The extender pigment ingredient promotes apparent drying of a surface of the ink and provides the ink with extensibility while regulating misregistration of the ink.

The object carrying unit 6 includes a conveyor 61 and holders 62 for holding, on the conveyor 62, the object F onto which the ink is to be transferred. The object carrying unit 6 is continuously driven so as to be moved at a speed corresponding to a speed of movement of the transfer film F by means of a drive motor or the like. The conveyor 61 is arranged so as to define a traveling path of a triangular configuration as viewed from a lateral side of the unit 6. The conveyor 61 is so constructed that a lower portion thereof downwardly forces or presses the object W against the surface of the water L in the water tank 3 for a predetermined period of time and then draws up it from the water surface after the ink pattern on the transfer film F floating on the water surface is transferred to the object W. In the illustrated embodiment, an extension L7 mounted in a lamp unit L1, which will be described hereinafter, may be used as the object W, to which the ink is transferred. Thereafter, the object W is subjected to showering, resulting in the water-soluble film component being washed out from the material W. Then, the object W is subjected to blasting of compressed air, so that water droplets of a large size may be blown off from the material W and then fed to the dryer or draining unit 7.

The draining unit 7 functions to permit the object W of which a surface is still wet to be dried to a considerable degree or permit most of water remaining on the object W to be removed. Such drying will be referred to as "draining" hereinafter. For this purpose, the draining is carried out for about 15 minutes at a temperature of about 80° C.

The volatilization promoting dryer 8 functions to volatilize the plasticizer ingredient and the like contained in the activator K. Thus, the volatilization may take place for about 30 to 60 minutes at a temperature of about 120° C.

In the illustrated embodiment, the activator K is coated on the transfer film F before it reaches the water L in the water tank 3 while the transfer film F is continuously fed to the water tank 3. Also, the object carrying unit 6 of the triangular conveyor type successively dips the objects W into the water L at predetermined lead-in and lead-out angles. Alternatively, the illustrated embodiment may be so constructed that the activator K is coated on the transfer film F after the transfer film F reaches the water L and the transfer film F is batch-treated in the form of a sheet while being floated every sheet. The object W may be vertically dipped in the water L.

Now, the manner of operation of the curved-surface printing apparatus of the illustrated embodiment thus constructed will be described hereinafter together with curved-surface printing applicable to a member exposed to a high-temperature closed atmosphere.

First of all, the transfer film F is drawn out of the film roll 41 and passed through the heating rolls 42, followed by coating of the activator K onto the ink-applied surface P of the transfer film F by means of the roller coater 51. In the prior art, dibutyl phthalate (DBP) is used as the plasticizer for the activator. On the contrary, in the present invention, dimethyl phthalate (DMP) or diethyl phthalate (DEP) is used as the plasticizer. The inventors made a test of carrying out comparison of a haze between a test plate which was subjected to transfer printing and draining and a test plate which was subjected to the volatilization promoting drying treatment after the transfer printing and draining treatments. As a result, it was found that fogging of the lamp unit L1 occurring in the prior art would be substantially due to evaporation of dibutyl phthalate (DBP).

Then, the activator K containing such a plasticizer is coated onto the ink-applied surface P by means of the roller coater 51 and then the transfer film F is carried onto the water L in the water tank 3 through the drawing-out rolls 43 while keeping the ink-applied surface P upwardly facing. This renders the transfer film F floating on the water L in the water tank 3, resulting in swelling of the transfer film M by the water L being initiated and gradually spread. Concurrently, the transfer film F is continuously moved to a downstream side by cooperation of a stream of the water L and the chain conveyor 33 arranged in the water tank 3 with each other.

Concurrently, the object W is downwardly forced or pressed against the transfer film F from above the water tank 3 while being carried at substantially the same speed as that of movement of the transfer film F by means of the object carrying unit 6, resulting in transfer printing of the ink being carried out. Then, the object W is drawn up from the water tank 3 by means of the object carrying unit 6 and then removed from the carrying unit 6. Thereafter, the object W is subjected to showering, resulting in the water-soluble film ingredient being washed out from the object W and then subjected to blasting of compressed air to blow off water droplets of a large size from the object W. Then, the object W is fed to the draining unit 7, so that the object W of which a surface is still wet may be dried. Subsequently, the object W is fed to the volatilization promoting dryer 8, wherein the plasticizer ingredient and the like contained in the activator K are volatilized from the object W. Lastly, the object W is subjected to a topcoating treatment using a clear paint or the like, resulting in the curved-surface a printing being completed. The volatilization promoting drying permits the solvent ingredient and the like which would cause fogging other than the plasticizer ingredient to be likewise volatilized or evaporated from the object W. The inventors made a haze test while using each of dimethyl phthalate (DMP) and diethyl phthalate (DEP) as the plasticizer and carrying out volatilization promoting drying. As a result, it was found that the object thus obtained exhibits satisfactory advantages.

More specifically, a lamp unit was assembled using an extension which was subjected to the conventional water pressure transfer printing techniques and then subjected to a lighting test. As a result, fogging occurred in the lamp unit to a degree sufficient to render the lamp unit unserviceable in a short period of time. This would be caused by film forming ingredients including a transfer ink formed by the water pressure transfer printing. In particular, it would be considered that occurrence of the fogging is mainly due to the transfer ink. However, as a result of a careful study by the inventors, it was supposed that the fogging is not due to the transfer ink but the activator K used for providing the transfer ink with stickiness. Also, the activator K is a mixed composition, therefore, the inventors doubted high-boiling substances such as the solvent and the like contained in the activator K. Thus, a specimen made of polycarbonate was subjected to water pressure transfer printing without any undercoat and topcoat essentially required for a specimen for a haze test.

First, measurement of a glass haze was carried out with respect to a specimen which was subjected to the conventional water pressure transfer printing treatment. The glass haze was 45%. Then, because any high-boiling substance contained in the activator K was doubted as described above, the volatilization promoting drying was carried out, for example, for 30 to 60 minutes at 120° C. and then a glass haze was measured. As a result, it was found that the glass haze was 12.3%, resulting in being highly improved. Also, in order to accomplish a haze of 10% or less, the ingredients contained in the activator K were successively studied. The result indicated that the plasticizer ingredient has a substantially high boiling point as compared with the solvent. Thus, a haze test was carried out with respect to a specimen (A) to which dibutyl phthalate (DBP) was added in an amount reduced to half as compared with the amount of DBP conventionally used and a specimen (B) to which dimethyl phthalate (DMP) was substituted for DBP in the same amount as DBP conventionally used. As a result, the specimens (A) and (B) were 27% and 32.1% in haze, respectively. Thus, a change of the plasticizer in the activator K failed to attain a haze of 10% or less.

The haze test was further repeated with respect to the specimens (A) and (B) while employing volatilization promoting drying. As a result, it was found that the specimen (A) in which DBP was reduced to half was 2% in haze and the specimen (B) to which DMP was added in the same amount as DBP conventionally used was 1% in haze, resulting in the haze being drastically improved. The test, as described above, was carried out with respect to the polycarbonate specimen as water pressure transfer printing being applied thereto without any undercoat and topcoat. Thus, the haze test was then carried out with respect to the specimen (A) and (B) each of which was subjected to undercoating for providing the specimen with a base color and adhesion, water pressure transfer printing, volatilization promoting drying and topcoating for providing the specimen with surface properties and suitable gloss. In this connection, the undercoat and topcoat per se individually attained a glass haze of 5% or less.

As a result, the specimen (A) which DBP was reduced to half and the specimen (B) to which DMP was added in the same amount as DBP conventionally used were 9% and 4.4% in glass haze, respectively. Thus, it was found that a change of the plasticizer from DBP to DMP and volatilization promoting drying cooperate with each other to permit the glass haze to be improved or reduced to a level of 5% or less. The reason for which the specimen (B) to which DBP was reduced to half were 9% in glass haze would be due to the fact that DBP migrates to the undercoat layer, resulting in remaining therein and then is volatilized. Also, the reason why the specimen (B) to which DMP was added in the same amount as DBP conventionally used was reduced to 4.4% in glass haze, would be due to the fact that migration of DMP to the undercoat layer is reduced as compared with that of DBP thereto. Thus, it was concluded that the above-described change of the plasticizer and employment of the volatilization promoting drying cooperate with each other to drastically improve or reduce the glass haze to a level of 5% or less. The same test was repeated on a specimen in which diethyl phthalate (DEP), having physical properties closely similar to DMP, is substituted for DMP. It was confirmed that DEP permits the glass haze to be 5% or less.

In the illustrated embodiment, the draining and volatilization promoting drying are carried out separately from each other. Alternatively, both steps may be combined together by adjusting a temperature of drying and a period of time thereof. Also, when the topcoating is carried out, a single drying step containing drying of the topcoat may be realized.

Now, the lamp unit L1 which may be subjected to curved-surface printing executed in such a manner as described above will be described hereinafter.

Figure 3:
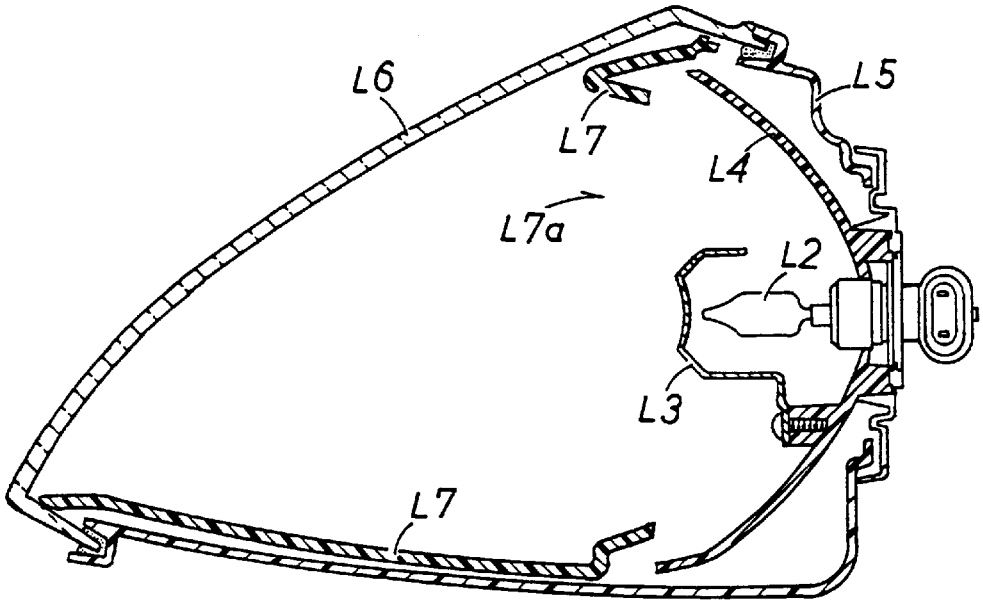
FIG. 3 is a sectional side elevation view showing an opening for a head lamp of the lamp unit.

The lamp unit L1, as shown in FIG. 3, includes a bulb L2 acting as a light source for emitting light, a shade L3 for intercepting a part of light emitted from the bulb L2, a reflector L4 for reflecting light emitted from the bulb L2, a lamp body L5 arranged behind the reflector L4, a lens L6 arranged so as to sealingly cover a whole front surface of the lamp body L5, and an extension L7 arranged between the lens L6 and the lamp body L5.

The bulb L2 may be constituted by a halogen bulb by way of example. Alternatively, an incandescent bulb or the like may be used for this purpose. The shade L3 and reflector L4 are each formed so as to have a configuration suitable for forming emitted light into a predetermined light distribution pattern. The reflector L4 may be formed of resin material such as, for example, polycarbonate or the like by molding. Alternatively, it may be made of a metal material such as iron or the like. Further, the reflector L4 may be formed in a configuration like a paraboloid of revolution having a parabolic section so that light radially emitted from the bulb L2 may be reflected thereby to form parallel light beams. An inner surface of the reflector L4 is subjected to a suitable surface treatment such as vacuum deposition of aluminum or the like, to thereby be improved in reflection.

The lamp body L5, as described above, is arranged behind the reflector L4, to thereby support the reflector L4 thereon and is covered on the whole front surface thereof with the lens L6 while being provided with sealing properties. For this purpose, the lamp body L5 is formed to have substantially the same front projected shape as the lens L6 and formed on a whole outer periphery thereof with a U-shape in section so as to receive the lens L6 therein. The lamp body L5 and lens L6 are fixed to each other using any suitable means such as an adhesive, a clip or the like, to thereby provide sealing properties therebetween.

The lens L6 is arranged so as to cover the lamp unit L1 in a hood-like manner and may be made of a resin material such as polycarbonate or the like by way of example. Alternatively, it may be suitably made of any other material such as glass. Also, in order to ensure that the shade L3 and reflector L4 form light irradiated from the bulb L2 into a predetermined light distribution pattern, the lens L6 is constructed in the form of a plain lens while being formed with no lens step. Thus, in the illustrated embodiment, the lens L6 substantially functions to cover the lamp unit L1 substantially without focusing and diffusing light. Nevertheless, the lens L6 may be formed on an inner surface thereof with lens steps, to thereby diffuse light.

The extension L7 is incorporated between the reflector L4 and the lens L6 and is formed at an outer periphery thereof with substantially the same configuration as the front projected configuration of the lens L6. Also, the extension L7 is formed at a portion thereof positionally corresponding to a light emitting section of the lamp unit L1 or a portion of a paraboloid of revolution of the reflector L4 with an opening L7*a*. The opening L7*a* is formed to have any suitable shape such as a round shape, a rectangular shape or the like in conformity to the front projected configuration of the light emitting section. For example, when the lamp unit L1, as shown in FIG. 2, is constructed so that a head lamp and a fog lamp which are conventionally used in the art are covered with the single lens L6, the extension L7 is formed with two such openings L7*a* one for the head lamp and the other for fog lamp, resulting in a relatively increased space being defined between the openings L7*a*. Such a space is generally utilized to form a suitable pattern thereon by curved-surface printing applicable to a member exposed to a high-temperature closed atmosphere, resulting in the lamp unit L1 being provided with an added value and distinct features. Thus, the pattern is usually formed in a manner to match in appearance with a car body while being prevented from generating fogging during lighting of the lamp unit L1.

Figures 2A, 2B:
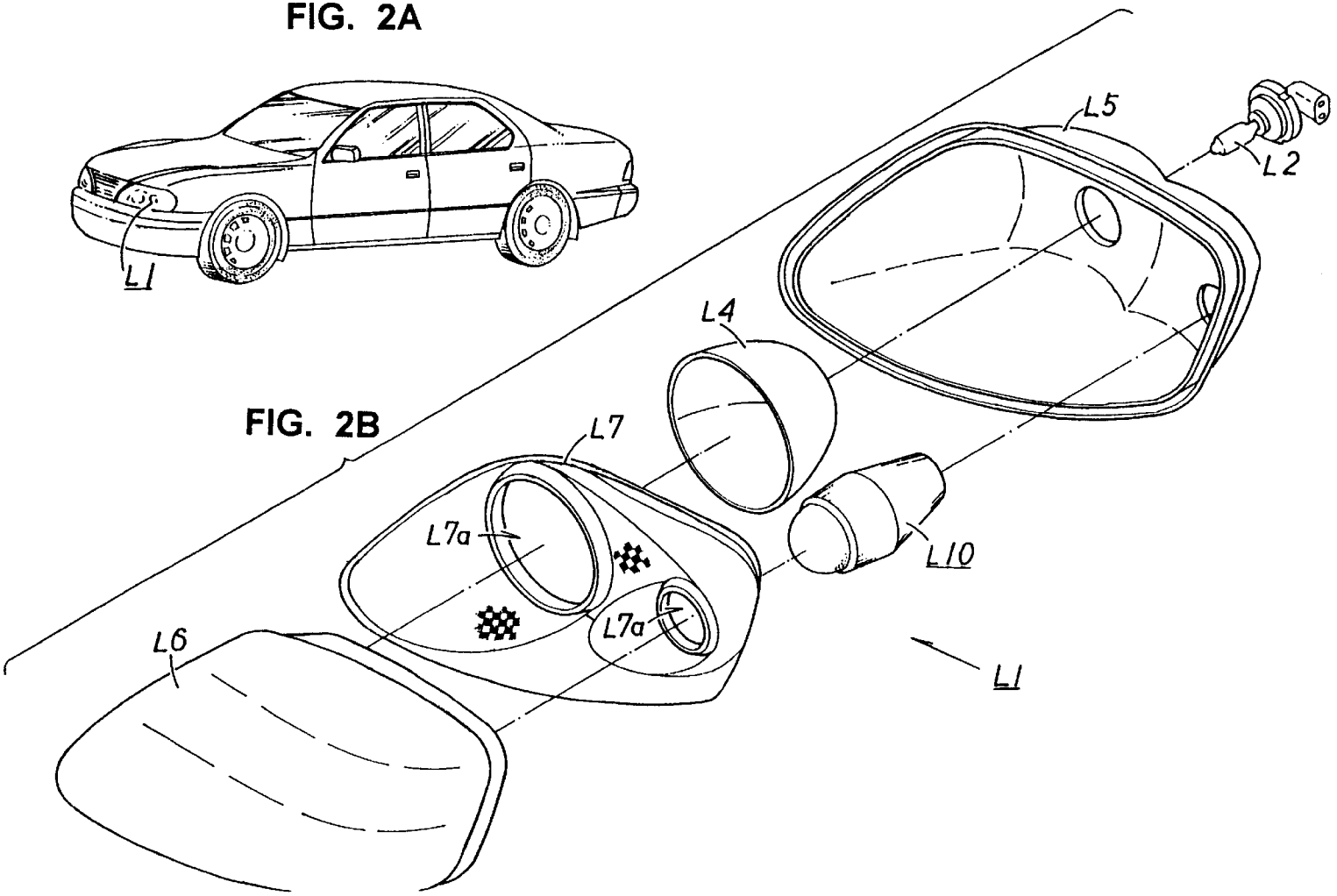
FIG. 2A is a schematic perspective view showing an automobile having a lamp unit incorporated therein.
FIG. 2B is an exploded perspective view showing the lamp unit according to the present invention.
Figure 4:
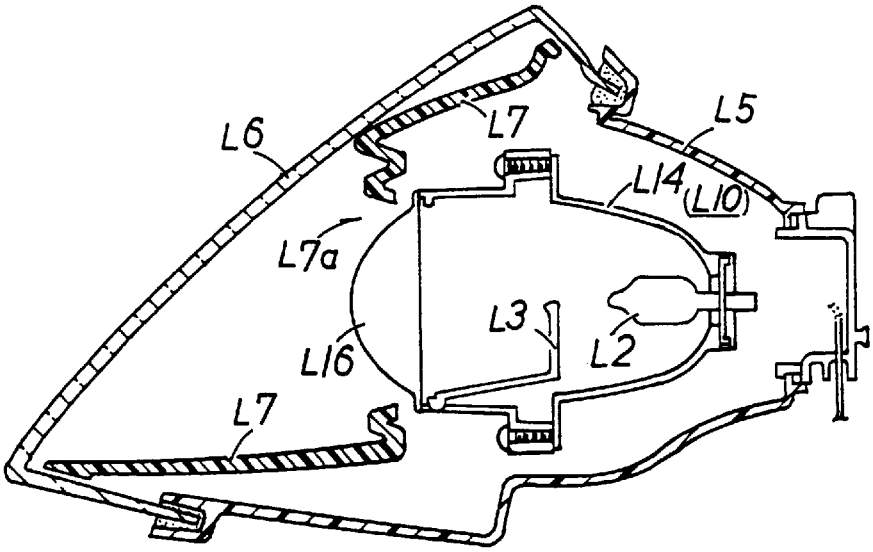
FIG. 4 is a sectional side elevation view showing an opening for a fog lamp of the lamp unit.

When the extension L7 is formed with two such openings L7*a*, both openings may each be formed to have a shape suitable for a normal head lamp. Alternatively, as shown in FIG. 2B, one of the openings L7*a* may be formed to have a large size for a normal head lamp and the other may be formed to have a small size for a fog lamp. In the latter case, a projector lamp unit L10 may be used for the fog lamp. The projector lamp unit L10, as shown in FIG. 4, may include a bulb L2, a shade L3, an elliptic reflector L14 and a converging lens L16, which may be integrally formed. The elliptic reflector L14 is formed to have an elliptic paraboloid shape, to thereby focus light emitted from the bulb L2. The converging lens L16 functions to permit focused light formed into a suitable light distribution pattern by the shade L3 to be diffused. Also, in such arrangement, an extension L7 is arranged on an outer periphery of the projector lamp unit L10 so as to support it thereon as shown in FIG. 4.

The extension L7 shown in FIG. 3 is arranged exclusively from a viewpoint of a design or for the purpose of improving an appearance of the lamp, whereas the extension L7 shown in FIG. 4 is arranged so as to exhibit both a function of supporting the projector lamp unit L10 thereon and a design function. Two such projector lamp units L10 may be combined together to constitute the lamp unit L1. Also, the lamp unit of the present invention may be constructed into a general-purpose unit such as a sealed beam-type unit wherein the reflector L4, the lens L6 and a filament are integrally formed, a semi-sealed beam-type unit wherein the reflector L4 and lens L6 are integrally formed, or the like. In the illustrated embodiment, the extension L7 has the large opening L7*a* and small opening L7*a* for the normal head lamp and fog lamp, respectively. Further, the extension L7 may be realized in the form of any suitable lamp such as a clearance lamp or the like other than such a head lamp as described above.

As can be seen from the foregoing, the curved-surface printing method of the present invention effectively attains curved-surface printing on a member exposed to a high-temperature closed atmosphere which the prior art never attains. Thus, application of the curved-surface printing of the present invention to, for example, a lamp unit positively prevents occurrence of fogging in the lamp.

Also, the lamp unit of the present invention permits an extension having any desired design applied thereto to be mounted therein, to thereby be provided with an added value.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A curved-surface printing method applicable to a member that will be exposed to a high-temperature closed atmosphere, the method comprising:

floating a transfer film on water in a water tank, said transfer film being formed by coating a transfer ink on a water-soluble film;

downwardly pressing an object against the transfer film to print the transfer ink on a surface of the object by water pressure;

applying an activator which contains a plasticizer ingredient selected from the group consisting of dimethyl phthalate (DMP) and diethyl phthalate (DEP) onto the transfer film, to thereby provide the transfer ink on the transfer film with a stickiness sufficient to ensure transfer of the transfer ink to the object; and carrying out a volatilization promoting drying treatment in order to substantially volatilize the plasticizer ingredient after the transfer ink has been transferred to the object, wherein the plasticizer ingredient remains on the object after the transfer ink has been transferred to the object.

2. A curved-surface printing method as claimed in claim 1, further comprising draining the object, a surface of which is still wet, prior to said volatilization promoting drying treatment.

3. A curved-surface printing method as claimed in claim 2, wherein said draining step is carried out for about 15 minutes at a temperature of about 80° C.

4. A curved-surface printing method as claimed in claim 2, wherein said draining step and volatilization promoting drying treatment are carried out in a single stage by adjusting a drying temperature and drying time.

5. A curved-surface printing method as claimed in claim 1, wherein said volatilization promoting drying treatment is carried out for about 30 to 60 minutes at a temperature of about 120° C.

6. A curved-surface printing method as claimed in claim 1, further comprising subjecting the object to undercoating prior to printing of the transfer ink on the surface of the object.

7. A curved-surface printing method as claimed in claim 1, wherein the object exhibits fogging of 10% or less in a glass haze test.

8. A curved-surface printing method as claimed in claim 7, wherein the object exhibits fogging of 5% or less in a glass haze test.

9. A curved-surface printing method applicable to a member that is subject to being exposed to a high-temperature closed atmosphere, the method comprising:

floating a transfer film on water in a water tank, said transfer film being formed by coating a transfer ink on a water-soluble film;

downwardly pressing an extension for a lamp unit against the transfer film to print the transfer ink onto a surface of the extension by water pressure;

applying an activator to the transfer film in order to provide the transfer ink on the transfer film with a stickiness that is sufficient to ensure transfer of the transfer ink to the extension, wherein said activator contains a plasticizer ingredient selected from the group consisting of dimethyl phthalate (DMP) and diethyl phthalate (DEP); and substantially volatilizing the plasticizer ingredient by carrying out a volatilization promoting drying treatment after the transfer ink has been transferred to the extension.

10. A curved-surface printing method as claimed in claim 9, further comprising:

showering the extension in order to remove a soluble film component from the extension; and blasting the extension with compressed air in order to remove water droplets from the surface of the extension; and feeding the extension to a draining unit to substantially dry the extension.

11. A curved-surface printing method as claimed in claim 1, further comprising:

showering the extension in order to remove a soluble film component from the extension; and blasting the extension with compressed air in order to remove water droplets from the surface of the extension; and feeding the extension to a draining unit to substantially dry the extension.

12. A curved-surface printing method applicable to a member that is subject to being exposed to a high-temperature closed atmosphere, the method comprising:

passing a transfer film, coated with a transfer ink, through heating rolls;

applying an activator onto the transfer film in order to provide the transfer film with a stickiness that is sufficient to ensure transfer of the transfer ink, wherein said activator contains a plasticizer ingredient selected from the group consisting of dimethyl phthalate (DMP) and diethyl phthalate (DEP);

transferring the transfer film to a water tank by means of a transfer film feed unit;

floating the transfer film on water contained in the water tank;

dipping successively extensions for a lamp unit into the water tank so as to downwardly press each extension against the transfer film to print the transfer ink onto a surface of the extension by water pressure; and substantially volatilizing the plasticizer ingredient by carrying out a volatilization promoting drying treatment after the transfer ink has been transferred to the extension.

13. A curved-surface printing method as claimed in claim 12, further comprising:

showering the extension in order to remove a soluble film component from the extension; and blasting the extension with compressed air in order to remove water droplets from the surface of the extension; and feeding the extension to a draining unit to substantially dry the extension.

14. A curved-surface printing method as claimed in claim 13, further comprising applying a topcoating treatment to the extension.

* * * * *